US006082983A

United States Patent [19]

Hayashi et al.

[11] Patent Number: 6,082,983

[45] Date of Patent: Jul. 4, 2000

[54] VANE PUMP

[75] Inventors: Tetsuji Hayashi; Kenichi Kuga, both of Tokyo, Japan

[73] Assignee: Kayaba Kogyo Kabushiki Kaisha, Tokyo, Japan

[21] Appl. No.: 09/068,732

[22] PCT Filed: Nov. 18, 1996

[86] PCT No.: PCT/JP96/03377

§ 371 Date: Jul. 20, 1998

§ 102(e) Date: Jul. 20, 1998

[87] PCT Pub. No.: WO97/19268

PCT Pub. Date: May 29, 1997

[30] Foreign Application Priority Data

Nov. 17, 1995 [JP] Japan ..... 7/323998

[51] Int. Cl.[7] ..... F01C 19/08

[52] U.S. Cl. ..... 418/133; 418/268

[58] Field of Search ..... 418/133, 268

[56] References Cited

U.S. PATENT DOCUMENTS 4,373,871 2/1983 Christ ..... 418/133 X
4,376,620 3/1983 Colston ..... 418/133 X
5,201,647 4/1993 Niemiec et al. ..... 418/133 X
5,496,155 3/1996 Noah et al. ..... 418/133 X
5,795,142 8/1998 Merz et al. ..... 418/133

FOREIGN PATENT DOCUMENTS 61-166884 6/1987 Japan .
63-167089 7/1988 Japan .

*Primary Examiner*—Hoang Nguyen
*Attorney, Agent, or Firm*—Rabin & Champagne, PC

[57] ABSTRACT

A vane pump is provided which does not require a core and wherein a cover is formed by diecasting. A body 1 supports a drive shaft 50 and houses a cam ring 30. A side plate 8 is interposed between the body 1 and cam ring 30. Low pressure ports 82 connected to intake areas of the cam ring 30, and high pressure ports 81 connected to discharge areas of the cam ring 30 and a high pressure port 12 inside the body 1, are respectively arranged symmetrically in the side plate 8. Branch passages 13 connected to a low pressure passage 9 are formed from an intake chamber 10 along the outer circumference of the cam ring 30 between the inner circumference of the body 1 and upper semicircular part of the cam ring 30. A cover 2 joined to the open end of the body 1 comprises an end face 2A which comes in contact with one face of the cam ring 30. Branch grooves 6 are formed in the end face 2A at positions corresponding to the intake areas of the cam ring 30.

4 Claims, 11 Drawing Sheets

VANE PUMP

FIELD OF THE INVENTION

This invention relates to a vane pump, and in particular a vane pump which is suitable as an oil pressure source for a power steering device of a vehicle.

BACKGROUND OF THE INVENTION

A vehicle such as an automobile comprises a power steering device which uses oil pressure. To supply this oil pressure, a vane pump is used such as is shown in FIG. 11 and FIG. 12.

This vane pump houses a cam ring 30, rotor 31 and vanes 32 which form a pump cartridge 3 inside the inner circumference of a body 107. The cam ring 30 and rotor 31 are positioned between a cover 106 fastened to the body 107 and a side plate 108 fixed to the inner circumference of the body 107.

The rotor 31 is joined to a drive shaft 100 which passes through the body 107. A pulley connected to an engine is joined to one end of the drive shaft 100. The drive shaft 100 drives the rotor 31 and vanes 32. The drive shaft 100 is supported by a bearing 120 provided on the inner circumference of the body 107 and a bearing 121 provided on the inner circumference of the cover 106. The drive shaft 100 is housed inside the cover 106, and does not pass through the cover 106.

The body 107 contains a high pressure chamber 101 formed between the inner wall of the body 107 and the side plate 108, a passage 111 connecting the high pressure chamber 101 and a valve cavity housing a flow regulating valve 4, an intake connector 105 connected to the outside of the body 107, and a low pressure passage 109 for recirculating surplus hydraulic fluid in the flow regulating valve 4 back to the pump cartridge 3. Hydraulic fluid supplied under pressure from the pump cartridge 3 via a throughhole in the side plate 108 is supplied to a power steering device, not illustrated, via the passage 111 and flow regulating valve 4. Surplus hydraulic fluid from the flow regulating valve 4 and hydraulic fluid from the intake connector 105 flow into the interior of the cover 106 from the low pressure passage 109, and are sent to intake regions of the pump cartridge 3 via branch passages 102, 102. The branch passages 102, 102 are formed in a bent shape inside the cover 106. As the cover 106 comprises the branch passages 102, 102, it is formed by demolding with a core. In a sliding region between the cover 106 and rotor 31, or between the cover 106 and vanes 32, strength is maintained by a thick part 106A having a predetermined thickness formed between the branch passages 102 and sliding surface.

On the other hand, hydraulic fluid which has leaked from one face of the cam ring 30, and from the sliding surface between the rotor 31 and side plate 108, is recirculated to the low pressure passage 109 from the outer circumference of the bearing 120 via the drain passage 112. The drain passage 112 is slanted at a predetermined angle relative to the drive shaft 100.

In addition to the vane pump described above, another example of a vane pump housing a pump cartridge inside a body is disclosed in Jikkou-Sho 61-36794. Therein, a rotor 222 joined to a shaft 224 is housed inside a body 210, as shown in FIG. 13. This rotor 222 is gripped by a pair of side plates 215, 216. The side plate 216 nearer the end of the drive shaft is housed within the inner circumference of a cover 212 joined to the body 210. A high pressure chamber 237 is formed between this side plate 216 and the cover 212. A cam ring 214 and the rotor 222 are gripped between the side plates 216, 215 by hydraulic fluid at high pressure which is led to this high pressure chamber 237.

A low pressure intake chamber 229 is formed along the outer circumference of the cam ring 214. Hydraulic fluid in the intake chamber 229 is aspirated from intake regions of the side plates 215, 216.

However according to the first prior art, in order to form the hollow branch passages 102 and thick part 106A inside the cover 106, the cover 106 has to be formed by gravity diecasting using a core (gravity mold casting). Due to the use of a core, the cover 106 cannot be manufactured by diecasting which is more productive, and it is difficult to reduce manufacturing costs and make the cover more compact and lightweight. The slanting drain passage 112 and the valve cavity housing the flow regulating valve 4 inside the body 107 are formed by machining after casting. Due to the slanting passage 112, the dimensions of the vane pump cannot be reduced in the axial direction. This leads to an increase in the number of machining steps, and higher manufacturing costs. Further, the drive shaft 100 is supported by the bearing 121 which is provided in the cover 106. The contact surface between the cover 106 and body 107 must be precision-finished in order to ensure orthogonality of the cover 106 and drive shaft 100, and concentricity of the bearing 121 and drive shaft 100. This also leads to an increase in the number of machining steps, longer machining time, and higher production cost. To house the cam ring 30 inside the inner circumference of the body 107 so that its entire circumference is enclosed, a partition 109A must be provided between the low pressure passage 109 and cam ring 30, which makes it difficult to make the vane pump more compact and lightweight in the radial direction.

Also, according to the second prior art, the number of parts increases due to the two side plates 215,216. As the side plate 216 is housed by the cover 212, the cover 212 must be formed in a hollow shape, which leads to an increase in the number of machining steps and machining time. In order to form the high pressure chamber 237 by enclosing a seal ring 238 between this cover 212 and side plate 216, it is necessary to precision-machine the contact surfaces, and to form a groove to enclose the seal ring 238. This again leads to an increase in the number of machining steps, machining time and manufacturing costs. Further, the intake chamber 229 is formed over the whole of the outer circumference of the cam ring 214, which makes the body 107 bulkier in the radial direction, and makes it difficult to make the pump more compact.

According to the vane pump of this invention, there is no hollow passage formed inside the cover, core manufacture and machining steps are omitted, and the structure of the cover is simplified. Since a core is no longer necessary to produce the vane pump, the pump can be manufactured by diecasting. This simplifies machining of the body and cover, and the vane pump can be made more compact and lightweight.

DISCLOSURE OF THE INVENTION

This invention provides a vane pump comprising:

- a cam ring housing a rotor joined to a drive shaft, and vanes free to move in the rotor in a radial direction,
- a body supporting the drive shaft and housing the cam ring,
- a side plate provided between the body and cam ring having a first low pressure port in a position corresponding to an intake area of the cam ring and a high pressure port connecting to a high pressure chamber in the body in a position corresponding to a discharge area, the ports being respectively arranged in symmetrical positions, an intake chamber formed inside the body as a gap between the inner circumference of the body and an upper part of the outer circumference of the cam ring, and connected to a low pressure passage for introducing hydraulic fluid from outside the pump, branch passages formed as a gap between the inner circumference of the body and the upper semicircular part of the cam ring, connecting the first low pressure port in the side plate and the intake chamber, and a cover having an end face joined to the open end of the body, and in contact with one face of the cam ring, a second low pressure port in a position corresponding to an intake area of the cam ring and low pressure distributing groove connected to the intake chamber, the groove being formed alongside the upper semicircular area of the outer circumference of the cam ring and extending towards the second low pressure port.

When the rotor is driven inside the cam ring, on one side of the cam ring, hydraulic fluid in the intake chamber connected to the low pressure passage is aspirated into intake regions of the cam ring from second low pressure ports via the low pressure distributing groove split into two branches on the surface of the cover. On the other side of the cam ring, hydraulic fluid is aspirated via branch passages connected to the intake chamber, into intake regions of the cam ring from the gap between first low pressure ports of the side plate and the surface of the cam ring. Hydraulic fluid which is discharged from discharge regions of the cam ring is supplied under pressure through the side plate from the high pressure chamber in the body to the outside of the pump via the flow regulating valve. As hydraulic fluid supplied to the second low pressure ports from the cover passes through the low pressure, branched distributing grooves formed in the cover face, there is no need to form a hollow passage for low pressure hydraulic fluid inside the cover using a core. The cover can therefore be formed simply by diecasting, production is improved and manufacturing costs are reduced. Further, as branch passages outside the cam ring are also formed as the gap between the outer circumference of the cam ring and upper semicircular area of the side plate, and the inner circumference of the body, increase in the outer diameter of the body is suppressed and the pump can be made more compact and lightweight. As the interior of the body is formed in a hollow shape, the body can be manufactured by diecasting and productivity can be further improved. Further, as the intake chamber and branch passages can easily be formed by assembling the cam ring and side plate from the open end of the body, the number of component parts and machining time are reduced, ease of assembly is enhanced and manufacturing costs are less.

According to an aspect of this invention, the cam ring and side plate are inserted from the open end of the body which is joined to the cover and are arranged on the inner circumference thereof, seals are gripped between the perimeter thereof and the end face of the cover, plural fastening mechanism are provided outside this perimeter for fastening the cover to the body, and seats of the fastening mechanism extend at a predetermined distance from the perimeter towards the cover.

The body and cover are joined by fastening mechanism, wherein a plurality of bolt fastening seats arranged on the perimeter of the open end of the body and extending towards the cover are brought in contact with the end face of the cover. Only the bolt fastening seats therefore have to be precision finished. Compared to the prior art where the entire perimeter of the open end has to be finished to a predetermined degree of precision, machining time and the number of machining steps are considerably reduced, and manufacturing costs are less. Further, the body is sealed only by seals gripped between the end face of the cover and the perimeter of the open end of the body, but as the cam ring and side plate are enclosed by the low pressure intake chamber and branch passages, discharge pressure does not act on the seals. Hence, leakage of hydraulic fluid can be prevented and the interior of the vane pump sealed even by using seals of low pressure withstanding properties. Therefore seal properties are enhanced while lowering manufacturing costs.

According to another aspect of this invention, the high pressure port is formed as a throughhole in the side plate, the first low pressure port is formed in the side plate as a step having a predetermined depth extending from the outer circumference thereof to a position corresponding to an intake area of the cam ring, and the ports are connected to the branch passages via a gap formed between one face of the cam ring and this step.

The first low pressure ports are connected to the branch passages via the gap between the end face of the cam ring and the step in the side plate. Low pressure hydraulic fluid in the intake chamber is aspirated from the first low pressure ports. There is therefore no need to provide a special passage to supply hydraulic fluid to the first low pressure ports, the number of component part and machining steps are reduced, and manufacturing costs are lowered.

According to yet another aspect of this invention, the body comprises a low pressure passage arranged parallel to the drive shaft, an inlet port connected to the low pressure passage for introducing hydraulic fluid from outside the pump, and a drain passage provided as an extension coaxial with the inlet port and extending to the hole through which the drive shaft passes for recirculating hydraulic fluid which has leaked into the hole back to the low pressure passage, the drain passage being arranged in a plane perpendicular to the drive shaft, and the inlet port and drain passage being formed in a one-piece construction by demolding pins.

Passages inside the body are formed in a one-piece construction by demolding pins. Hence, the body can be manufactured by diecasting without the use of machining, and productivity is largely improved compared to the case of gravity diecasting as in the aforesaid prior art.

PREFERRED EMBODIMENTS OF THE INVENTION

This invention will now be described in more detail with reference to the attached drawings.

FIGS. 1–10 show one embodiment of a vane pump to which this invention is applied.

Figure 1:
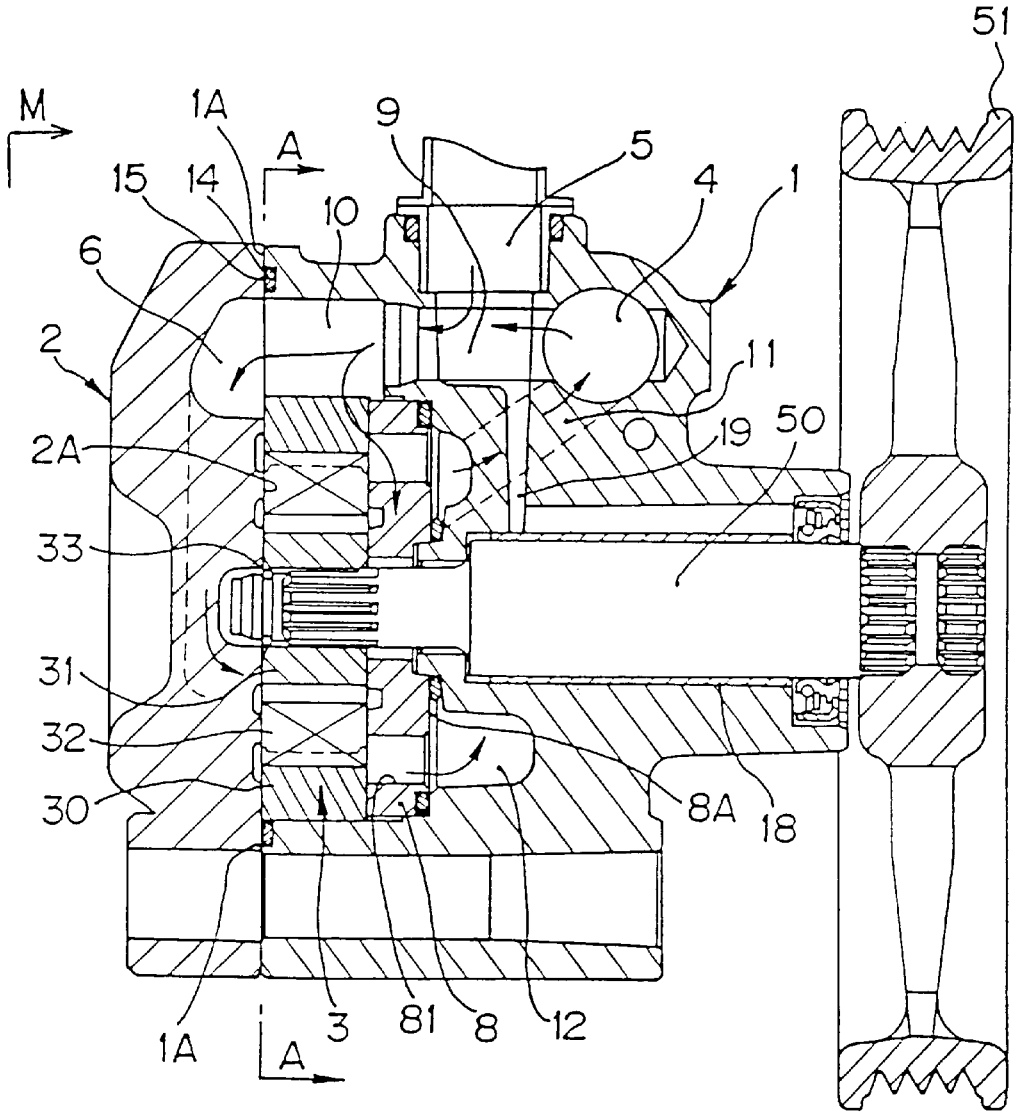
FIG. 1 is a cross sectional view of a vane pump showing one embodiment of this invention.
Figure 2:
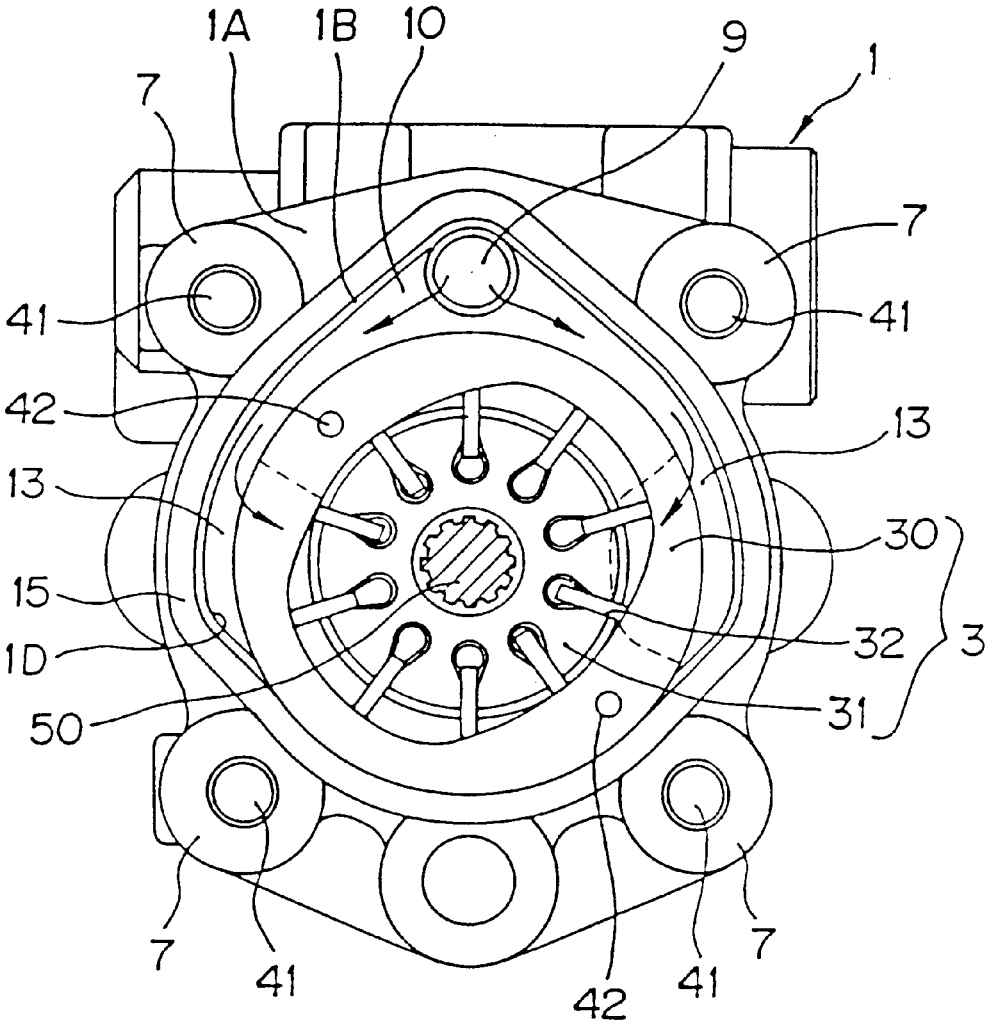
FIG. 2 is a view taken in the direction of the arrow A of FIG. 1.

In FIG. 1 and FIG. 2, a body 1 of the vane pump supports a drive shaft 50 whereof one end is joined to a pulley 51. The body 1 comprises a valve cavity housing a flow regulating valve 4. A side plate 8 and pump cartridge 3 are installed in the body 1 from an open end 1A of same on the opposite side to the pulley 51. The pump cartridge 3 comprises a cam ring 30 in which a rotor 31 is free to rotate. A cover 2 is joined to the open end 1A. The pump cartridge 3 comprises for example vanes 32, the rotor 31 and the cam ring 30.

The drive shaft 50 passes through the body 1 effectively at its center, and it is supported in the body 1 by a bearing metal 18. A belt wound on the pulley 51, not shown, is connected to an engine. The drive shaft 50 drives the rotor 31 due to the force of the engine.

The flow regulating valve 4 is housed in a perpendicular direction to that of the drive shaft 50 inside the body 1 near to the pulley 51. Hydraulic fluid whereof the flow is adjusted, is supplied under pressure from a discharge port, not shown, to the outside of the vane pump, and thereby to a power steering device.

The end of the drive shaft 50 on the opposite side to the pulley 51 extends by a predetermined amount from the open end 1A, as shown in FIG. 1. A depression space is formed in the body 1 from the open end 1A. The pump cartridge 3 and side plate 8 are housed in this space. The cover 2, which is formed by diecasting, is fastened to the open end 1A of the body 1.

The pump cartridge 3 comes in contact with an end face 2A of the cover 2 facing the body 1. The disk-shaped side plate 8 is inserted between the end of the pump cartridge 3 nearer the body 1, and the base of the inner circumference of the body 1 which is formed as a depression. The pump cartridge 3 is gripped between the side plate 8 and cover 2.

The pump cartridge 3 comprises the rotor 31 engaged with splines on the drive shaft 50 inside the cylindrical cam ring 30, and vanes 32 supported by the rotor 31 which slide on the inner circumference of the cam ring 30, as shown in FIG. 2. The rotation of the cam ring 30 is restricted by a pair of dowel pins 42, 42 which project from the body 1. The dowel pins 42, 42 pass through the cam ring 30 and side plate 8, and hold the cam ring 30 and side plate 8 in a predetermined positional relationship.

As shown in FIG. 1, the rotor 31 engages with the drive shaft 50 due to cir-clip 33 provided on the drive shaft 50. The cir-clip 33 restricts the movement of the drive shaft 50 to the right-hand side of the figure.

Discharge regions of the pump cartridge 3 face high pressure ports 81 formed as throughholes in the side plate 8, and are connected with a high pressure chamber 12 of the body 1 in a predetermined positional relationship. Likewise, intake regions of the pump cartridge 3 are connected with first and second low pressure ports 82, 6A (FIG. 10, FIG. 4), which are formed respectively in the side plate 8 and cover 2, in a predetermined positional relationship. The cam ring 30 can aspirate hydraulic fluid almost uniformly from both sides in an axial direction.

A cylindrical intake connector 5 is joined to the upper part of the body, the lower part of this intake connector 5 being connected with a low pressure passage 9 which is substantially horizontal in the figure, as shown in FIG. 1. The left-hand end of the low pressure passage 9 in the figure opens into the perimeter of the base of the depressed inner circumference of the body.

An intake chamber 10 is formed with a predetermined gap by the upper part of the inner circumference of the body 1, and the outer circumference of the cam ring 30 and side plate 8. The low pressure passage 9 which opens into the base of the inner circumference of the body 1, connects with this intake chamber 10. The right-hand end of the low pressure passage 9 connects with the bypass side of the flow regulating valve 4 which discharges surplus hydraulic fluid. Surplus hydraulic fluid from the flow regulating valve 4 mixes with low pressure hydraulic fluid supplied from the intake connector 5, and the mixture flows via the low pressure passage 9 into the intake chamber 10 which is formed by the inner circumference of the body 1 and the outer circumference of the cam ring 30.

In FIG. 1, the high pressure chamber 12 connected with the high pressure port 81 of the side plate 8, is connected with the flow regulating valve 4 via a passage 11 which is inclined upwards. Hydraulic fluid which has leaked from the pump cartridge 3 flows toward the pulley 51 along the drive shaft 50, and is led into the low pressure passage 9 via a drain passage 19 which extends toward the drive shaft 50 from the lower end of the intake connector 5. The axis of this drain passage 19 is formed as a line in a plane which is substantially perpendicular to the drive shaft 50.

The side plate 8 interposed between the base of the depressed inner circumference of the body 1 and the end face of the pump cartridge 3 is formed as a disk-shaped member, as shown in FIG. 10(A),(B). The end face 8A of the side plate 8 comes in contact with the body 1, and the end face 8B of the side plate 8 comes in contact with the cam ring 30.

As described hereabove, the pair of high pressure ports 81 are formed as throughholes in the side plate 8 at positions facing the discharge regions of the cam ring 30. These high pressure ports 81, 81 are arranged on opposite sides across a drive shaft hole 80 through which the drive shaft 50 passes.

Steps are also formed at positions which are offset by 90° from the high pressure ports 81, 81 in the end face 8B which comes in contact with the cam ring 30. These steps form the first low pressure ports 82, 82. These low pressure ports 82, 82 are connected with branch passages 13, 13 via a gap formed between the cam ring 30 and side plate 8. The branch passages 13, 13 are formed in such a way that hydraulic fluid which flows into the intake chamber 10 from the low pressure passage 9 opening into the upper part of the cam ring 30, branches off at the upper part of the cam ring 30, and flows into the low pressure ports 82, 82 on one side of the cam ring 30 and side plate 8, as shown in FIG. 2.

Figure 5:
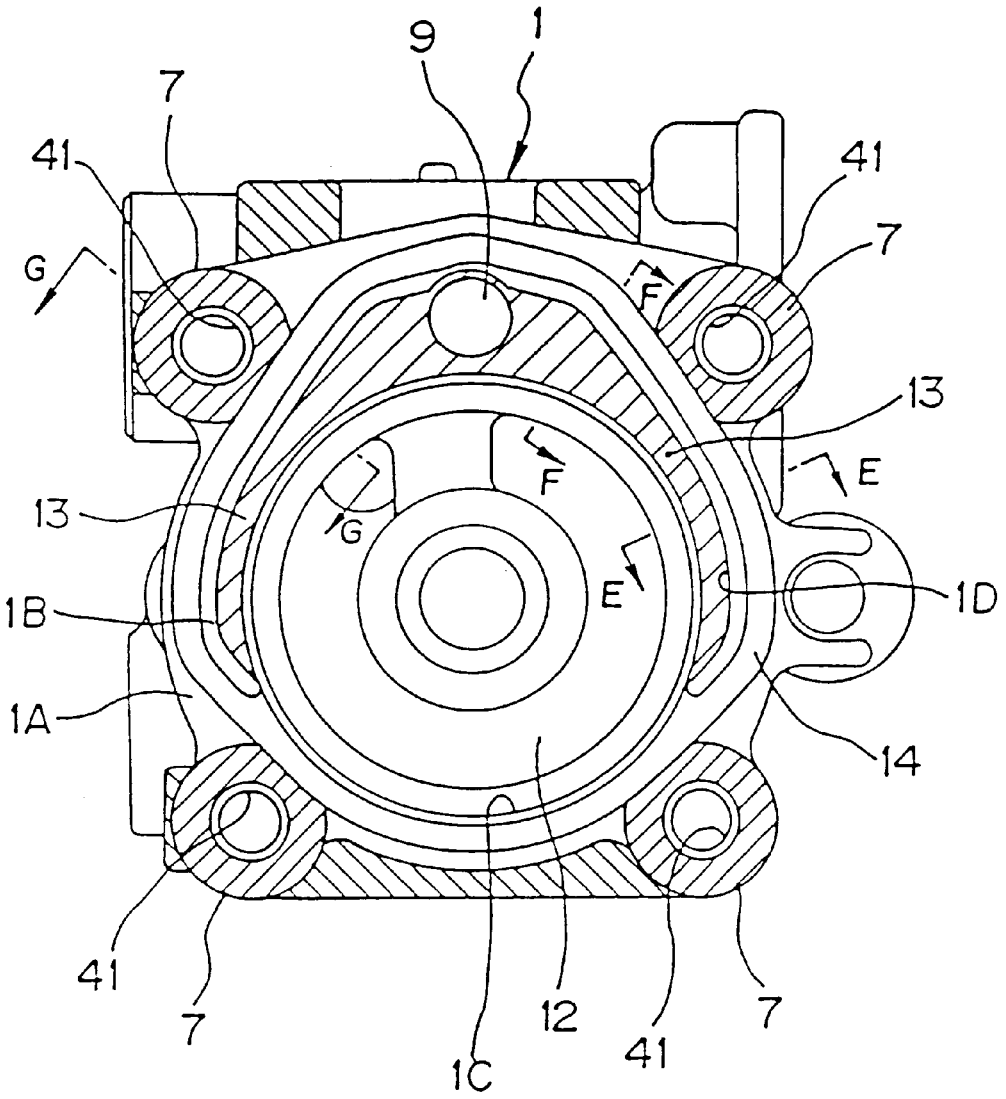
FIG. 5 is a view of the body alone taken in the direction of the arrow A in FIG. 1.
Figure 6:
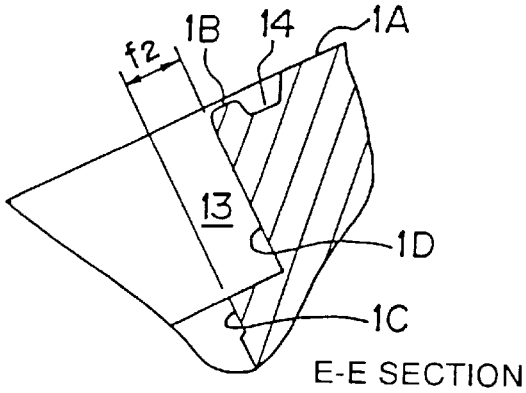
FIG. 6 is a sectional view taken along a line E—E of FIG. 5.
Figure 7:
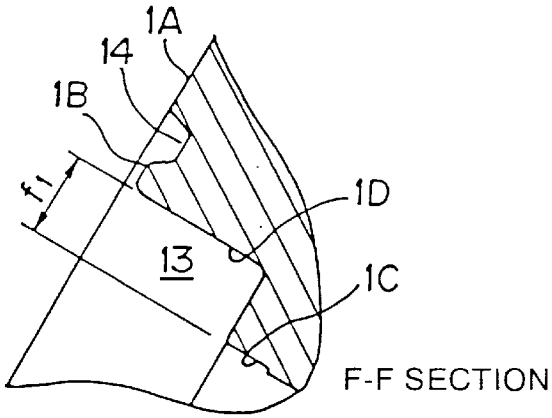
FIG. 7 is a sectional view taken along a line F—F of FIG. 5.

The branch passages 13 are formed as a space between an inner wall 1D and the upper semicircular part of the outer circumference of the cam ring 30, as shown in FIG. 2 and FIG. 5. The inner wall 1D is formed in the inner circumference of the body 1 at the end of a hole 1C which opens into the body 1, this hole engaging with the side plate 8. The width of the branch passages 13 gradually increases in a radial direction from the sides towards the intake chamber 10 in the upper part of the pump, as shown in FIG. 6 and FIG. 7.

Hydraulic fluid aspirated from the intake chamber 10 via the branch passages 13, flows to the left and right along the cam ring 30 on the side of the cam ring 30 adjacent to the side plate 8. The hydraulic fluid so distributed is then aspirated almost uniformly into the intake regions of the cam ring 30 from the left and right of FIG. 2 through the end face of the cam ring 30 and the low pressure ports 82 of the side plate 8.

Vane back pressure slots 83 of a predetermined depth for leading back pressure into the bases of the vanes 32 are formed in substantially circular positions in the end face 8B of the side plate 8. Holes 84, 84 engaging with the dowel pins 42 are formed at predetermined positions in the side plate 8.

Figure 3:
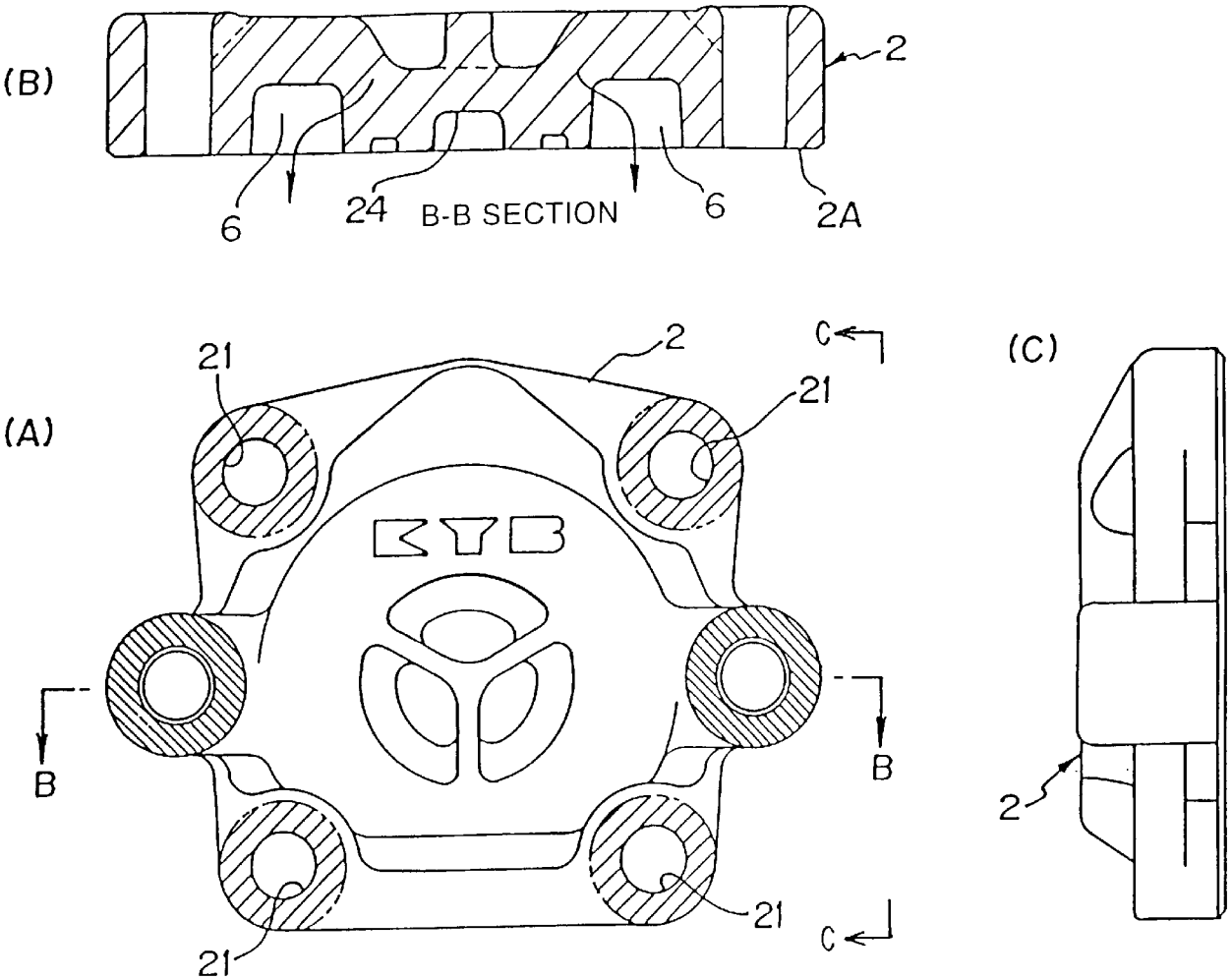
FIG. 3 is a diagram of a cover. (A) is a view taken in the direction of the arrow M of FIG. 1, (B) is a sectional view taken along a line B—B of (A), (C) is a view taken in a direction of the arrow C of (A).

Branch grooves 6, 6 of a predetermined depth for distributing low pressure are also formed in the end face 2A of the cover 2 at an opposite position to the intake chamber 10 of the body 1. The branch grooves 6, 6 extend from a position 9 opposite the low pressure passage 9 which opens into the body 1, along the outer circumference of the cam ring 30 which comes in contact with the end face 2A, as shown in FIG. 3 and FIG. 4.

As shown in FIG. 4(A), the branch grooves 6, 6 extend from the point 9' opposite the low pressure passage 9 to positions outside an escape hole 24 (on the left and right of the diagram). The escape hole 24 is formed at a predetermined depth such that the cover 2 does not come in contact with the end of the drive shaft 50. The branch grooves 6, 6 also extend further inwards at their lower ends. The extensions of these grooves 6, 6 form a pair of low pressure ports 6A, 6A on the side of the cover 2 facing the intake regions of the cam ring 30. The low pressure ports 6A, 6A are second low pressure ports.

Figure 4:
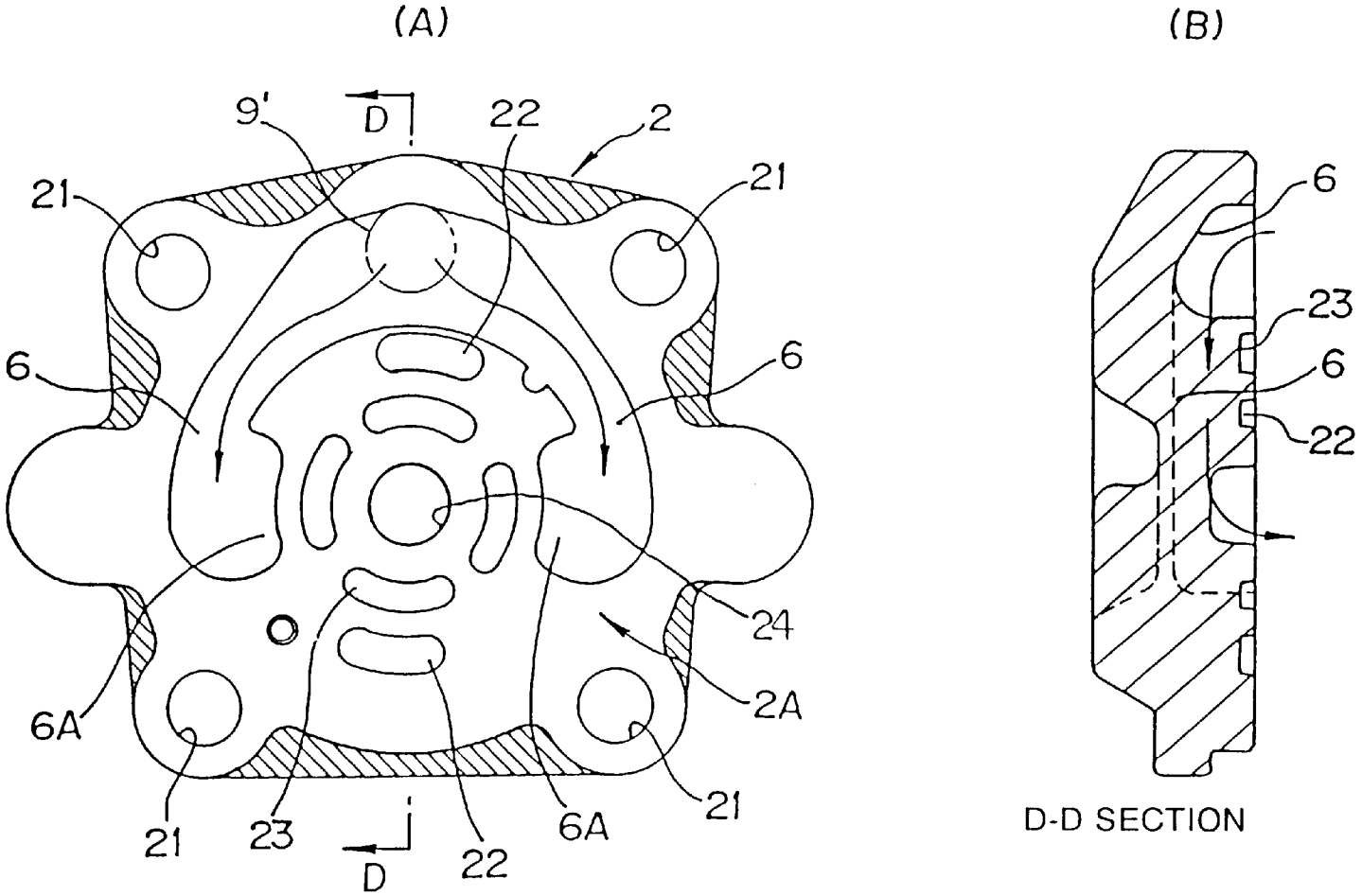
FIG. 4 is a diagram of the cover. (A) is a front view of the cover taken from the side of a body. (B) is a sectional view taken along a line D—D of (A).

Therefore, in the cover 2, hydraulic fluid flows from the intake chamber 10 in the upper part to the left and right of FIG.4 along the branch grooves 6, 6. This hydraulic fluid is aspirated almost uniformly into the intake regions of the cam ring 30 via the pair of low pressure ports 6A, 6A.

Due to the branch passages 13, 13 formed as a gap between the upper semicircular part of the outer circumference of the cam ring 30 and the inner circumference of the body 1, the ports 82, 82 which are steps formed in the side plate 8 gripping the cam ring 30 from an axial direction, and the branch grooves 6, 6 formed in the cover 2, the pump cartridge 3 aspirates hydraulic fluid effectively uniformly from the front and rear in the axial direction via the pairs of low pressure ports 82, 82, and 6A, 6A which are arranged substantially parallel to each other on either side of the cam ring 30.

As in the case of the side plate 8, vane back pressure grooves 23 are formed in substantially circular positions in the end face 2A of the cover 2 at positions corresponding to the bases of the vanes 32 in the rotor 31. The back pressure of the bases of the vanes 32 is also led to the cover 2 via the vane back pressure grooves 83 in the side plate 8.

Figure 8:
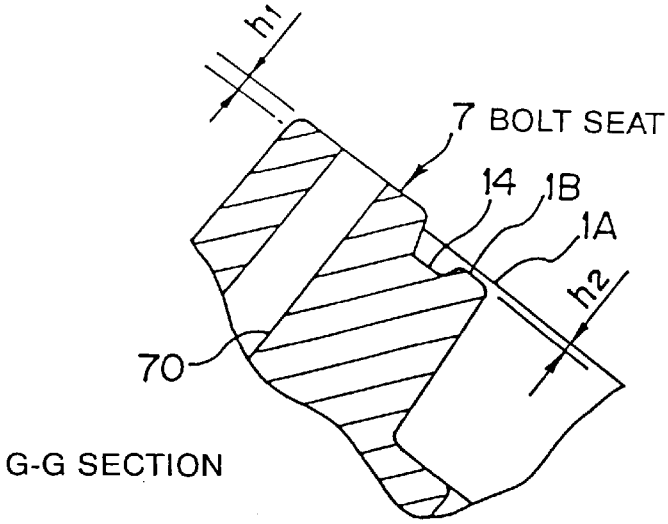
FIG. 8 is a sectional view taken along a line G—G of FIG. 5.

The cover 2 is fastened to the body 1 by bolts. A plurality of bolt fastening means 7 provided with bolt holes 41 are arranged at a predetermined interval on the perimeter of the open end of the body 1, as shown in FIG. 5 and FIG. 8. Bolt holes 21 corresponding to the bolt holes 41 are formed in the cover 2. The cover 2 is fastened to the body 1 by screwing bolts which pass through the bolt holes 21 in the cover 2, into the bolt holes 41.

A loop-shaped seal ring groove 14 of a predetermined depth is also formed on the inner circumference of the open end 1A, as shown in FIG. 5. A loop-shaped seal ring 15 is embedded in the seal ring groove 14. The seal ring 15 is pressed and gripped between the end face 2 of the cover 2 and the seal ring groove 14 so as to seal the hydraulic fluid in the low pressure intake chamber 10 and branch passages 13, 13.

An end face 1B which is lower than the end face 1A by a distance h2 is partially formed on the inner circumference of the seal ring groove 14 facing the intake chamber 10 and branch passages 13, 13, as shown in FIG. 6–FIG. 8.

Figure 9:
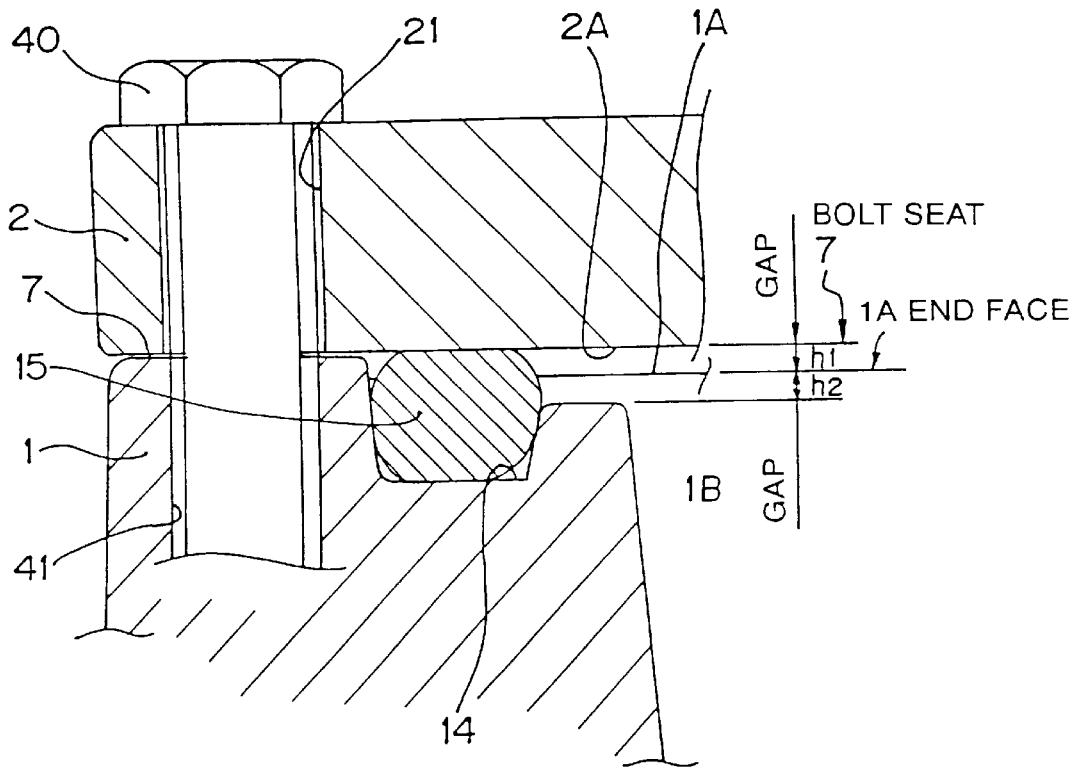
FIG. 9 is an enlarged sectional view taken along a line G—G of FIG. 5 showing the cover attached.
Figure 10:
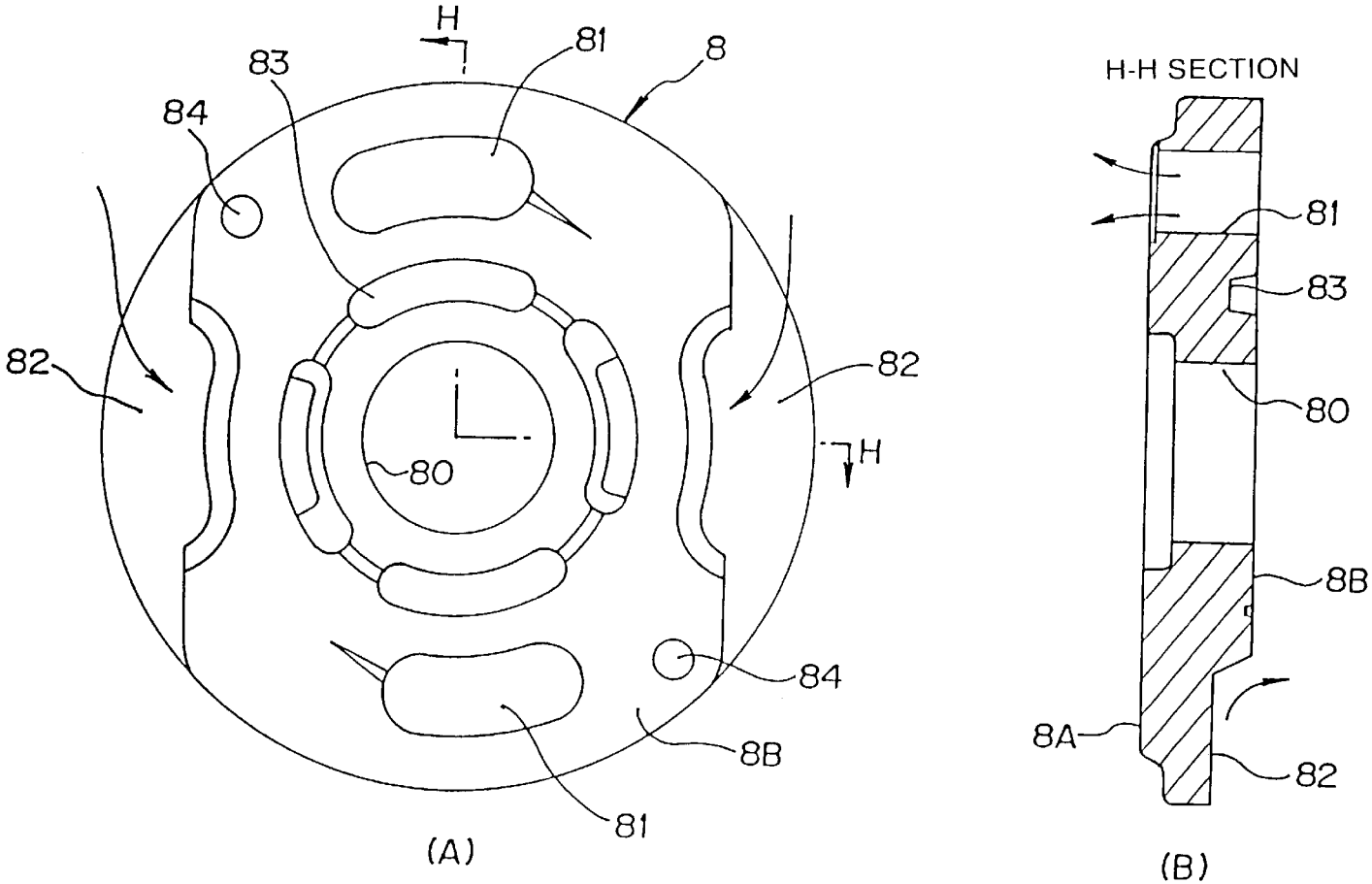
FIG. 10 shows a side plate. (A) is a front view, and (B) is a sectional view along a line H—H of (A).
Figure 11:
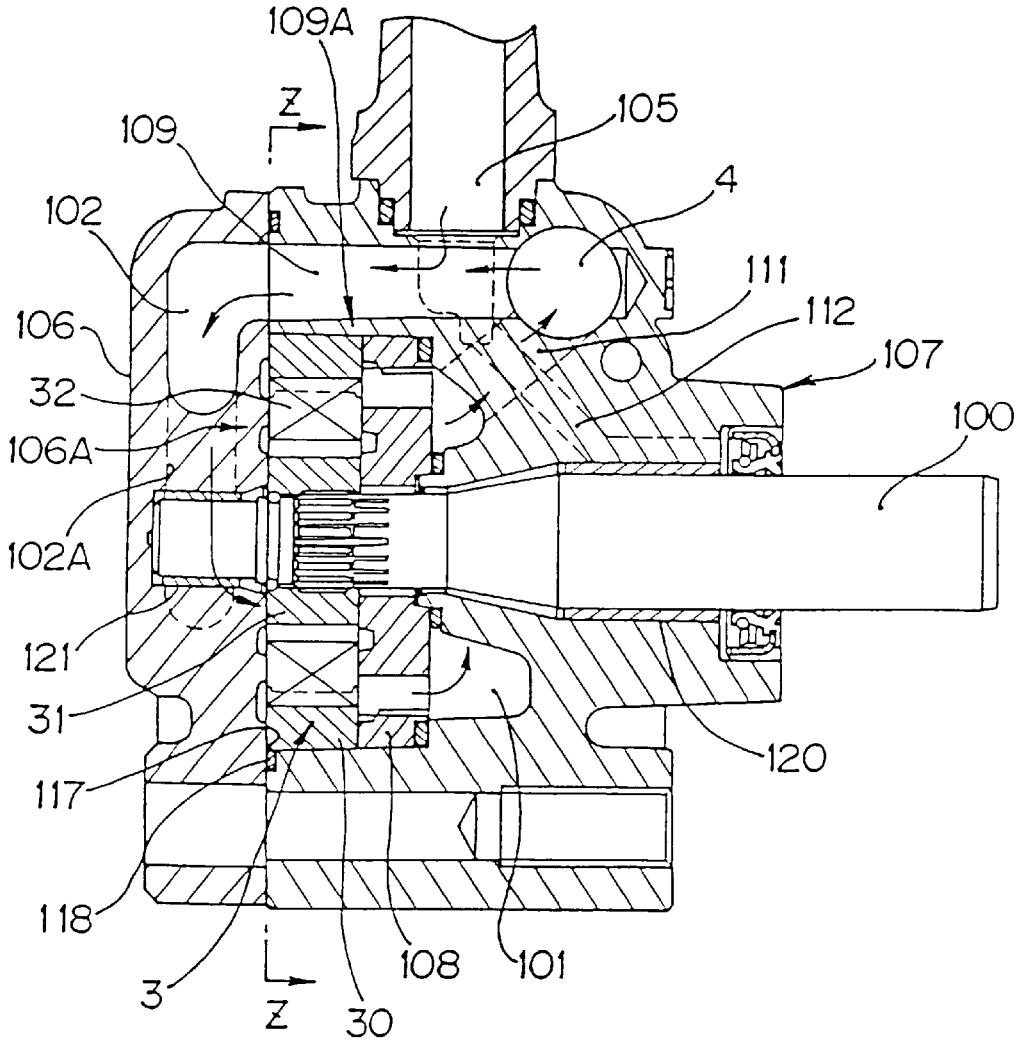
FIG. 11 is a sectional view of a vane pump according to the prior art.
Figure 12:
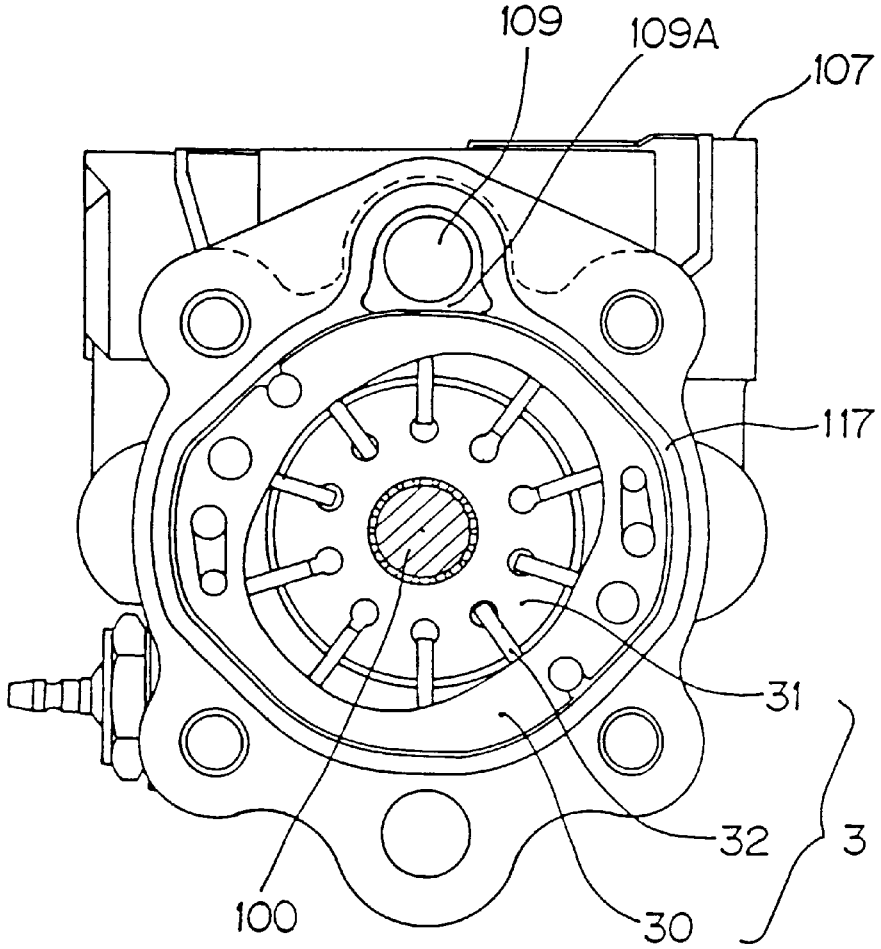
FIG. 12 is a view taken in a direction of the arrow Z of FIG. 11.
Figure 13:
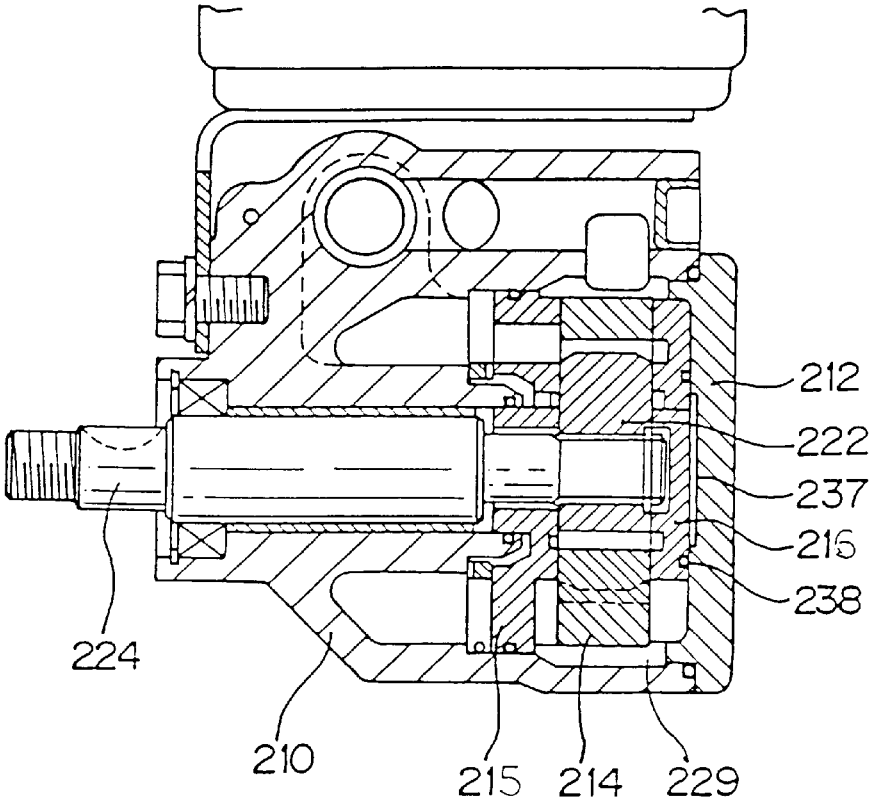
FIG. 13 is a sectional view of another vane pump according to the prior art.

As shown in FIG. 8, the four bolt fastening seats 7 formed at predetermined positions are respectively higher than the open end 1A, i.e. the bolt fastening seats 7 extend towards the cover. Therefore, as shown in FIG. 9, when bolts 40 passing through the bolt holes 21 of the cover 2 are screwed into the bolt holes 41 of the bolt fastening seats 7, the end face 2A of the cover 2 comes in contact with the body 1 only via this plurality of bolt fastening seats 7. The body 1 is sealed by pressing and gripping the seal ring 15 between the end face 2A and the seal ring groove 14. A gap h1 depending on the extending height of the bolt fastening seats 7 is formed between the open end 1A of the body 1 and the end face 2A of the cover 2, so the outer circumference of the seal ring 15 between the bolt fastening seats 7, 7 is visible from the outside of the pump.

Also, the lower semicircular part of the cam ring 30 on the perimeter 1A of the open end of the body 1A serves as a guide for the inner circumference of the seal ring 15.

Next, the action of this vane pump will be described.

When the drive shaft 50 is driven via the pulley 51, the rotor 31 in the pump cartridge 3 rotates. Hydraulic fluid is supplied from the intake connector 5, and enters the intake chamber 10 formed inside the body 1 via the low pressure passage 9.

The pump cartridge 3 which comprises the vanes 32, rotor 31 and cam ring 30, aspirates hydraulic fluid substantially uniformly from the left and right of the drive shaft 50 in FIG. 2 and FIG. 4, from the low pressure ports 6A, 82 respectively formed in the cover 2 and side plate 8, via the branch passages 13, 13 formed as a gap between the outer circumference of the cam ring 30 and inner circumference of the body 1, and the branch grooves 6, 6 formed in the cover 2.

Hydraulic fluid supplied under pressure from the high pressure ports 81 in the side plate 8 is led into the flow regulating valve 4 via the high pressure chamber 12 and passage 11 in the body 1. Hence, only the required amount of hydraulic fluid is supplied to the power steering device from the discharge port, not shown. Surplus hydraulic fluid is recirculated to the low pressure passage 9, mixes with hydraulic fluid from the intake connector 5, re-enters the intake chamber 10, and is distributed to the branch passages 13 and branch grooves 6.

As the hydraulic fluid passages formed in the cover 2 are the branch grooves 6, 6, there is no need to form a bent passage using a core as in the prior art. Therefore the pump can be manufactured by diecasting, and productivity and machining precision are improved as compared to pumps manufactured by prior art techniques. This also resolves quality assurance problems caused by the removal of the core. Moreover, as there is no need to form a hollow passage, the pump can be made thinner than in the prior art, thereby reducing manufacturing costs and enabling the pump to be made more compact and lightweight.

The low pressure passage 9 is arranged substantially parallel to the drive shaft 50, the drain passage 19 for recirculating leaked hydraulic fluid from the cam ring 30 back to the low pressure passage 9 is arranged in a plane perpendicular to the axis of the drive shaft 50, and the drain passage 19 is provided as an extension coaxial with the intake connector 5. The low pressure passage 9, the hole connecting the intake connector 5 and the drain passage 19, can therefore be simultaneously formed by diecasting using demolding pins, and productivity and machining precision are improved. Further, as the drain passage 19 is arranged in a perpendicular plane to the drive shaft 50, the dimensions of the body in the axial direction can be reduced, and it can be made more compact and lightweight compared to the body of the prior art comprising a slanting drain passage.

Discharge pressure acts on high pressure chambers 22 facing the discharge regions of the cam ring 30, and on the vane back pressure grooves 23. However the upper semicircular part from the upper part to the sides of the outer circumference of the cam ring 30 is covered by the low pressure chamber 10 and branch grooves 6, 6. The outer circumference of the high pressure regions is therefore enclosed by low pressure regions, and leakage of hydraulic fluid can be prevented solely by the seal ring 15 for sealing the intake chamber 10 and branch grooves 6, 6 which are low pressure regions.

The body 1 and cover 2 are in contact only via the bolt fastening seats 7 which extend by the distance h1 from the open end 1A of the body 1, as shown in FIG.5 and FIG.9. The outer circumference of the seal ring 15 between the plural bolt fastening seats 7, 7 is exposed over the distance h1 between the open end 1A of the body 1 and the end face 2A of the cover 2. However the seal ring 15 only needs to seal low pressure hydraulic fluid, therefore it does not need to have the strength to withstand pressure, and leakage of hydraulic fluid due to fluctuations of pump discharge pressure does not occur. Leakage of hydraulic fluid is definitively prevented by gripping the seal ring 15 under pressure between the end face 2A and the seal ring groove 14.

The branch grooves 6 and branch passages 13 for leading hydraulic fluid to the low pressure ports 6A, 82 are formed only in the upper semicircular part of the of the outer circumference of the cam ring 30. As the intake chamber 10 is formed as a gap between a predetermined part of the outer circumference of the upper part of the cam ring 30 and side plate 8 and the inner circumference of the body 1, there is no need for the partition 109A for separating the low pressure passage and cam ring as in the prior art. Hence, the number of component parts and machining points can be reduced while making the pump more compact in the radial direction and more lightweight.

The open end 1A of the body 1 after diecasting needs to be finished to a predetermined precision only on the surfaces of the bolt fastening seats 7 which come in contact with the end face 2A of the cover 2. The open ends 1A, 1B do not require any other finishing, consequently the area which has to be finished is much less than in the prior art where the entire end face circumference had to be finished to a predetermined surface precision. As a result, the time required for finishing after diecasting can be reduced, productivity can be improved and manufacturing costs can be lowered.

The drive shaft 50 is supported only by the bearing metal 18 of the body 1, the escape hole 24 being formed in the cover 2 to avoid contact with the end of the drive shaft 50. Therefore there is no need to support the drive shaft in the cover as in the prior art, and it is not necessary to use high machining precision to ensure perpendicularity between the axis of the drive shaft and the end face, or flatness of the end face. The structure of the cover 2 is also simpler, and the number of component parts and machining points can be reduced. This reduces manufacturing costs while offering compactness and lightweightness.

Further, the intake chamber 10 and branch passages 13, 13 can easily be formed simply by assembling the pump cartridge 3 comprising the cam ring and other components, and the side plate 8, in the interior of the body which has a depressed inner circumference, from the open end of the body. There is no need to form any special passages, the number of component parts is reduced, less machining is required and assembly can be automated, so assembly is easier is productivity is improved.

INDUSTRIAL APPLICATION OF THIS INVENTION

According to the vane pump of this invention, there is no hollow passage formed inside the cover, core manufacture and machining steps are omitted, and the structure of the cover is simplified. Since a core is no longer necessary to produce the vane pump, the pump can be manufactured by diecasting. This simplifies machining of the body and cover, and the vane pump can be made more compact and lightweight.

What is claimed is:

1. A vane pump comprising:

a cam ring housing a rotor joined to a drive shaft, and vanes free to move in said rotor in a radial direction, a body supporting said drive shaft and housing said cam ring, a side plate provided between said body and said cam ring having a first low pressure port in a position corresponding to an intake area of said cam ring and a high pressure port connecting to a high pressure chamber in said body in a position corresponding to a discharge area, said ports being respectively arranged in symmetrical positions, an intake chamber formed inside said body as a gap between the inner circumference of said body and an upper part of the outer circumference of said cam ring, and connected to a low pressure passage for introducing hydraulic fluid from outside said pump, branch passages formed as a gap between the inner circumference of said body and the upper semicircular part of said cam ring, connecting said first low pressure port in said side plate and said intake chamber, and a cover having an end face joined to the open end of said body, and in contact with one face of said cam ring, a second low pressure port in a position corresponding to an intake area of said cam ring and low pressure distributing groove connected to said intake chamber, said groove being formed alongside the upper semicircular area of the outer circumference of said cam ring and extending towards said second low pressure port.

2. A vane pump as defined in claim 1, wherein said cam ring and side plate are inserted from the open end of said body which is joined to said cover and are arranged on the inner circumference thereof, seals are gripped between the perimeter thereof and the end face of said cover, plural fastening means are provided outside this perimeter for fastening said cover to said body, and seats of said fastening means extend at a predetermined distance from said perimeter towards said cover.

3. A vane pump as defined in claim 1, wherein said high pressure port is formed as a throughhole in said side plate, said first low pressure port is formed in said side plate as a step having a predetermined depth extending from the outer circumference thereof to a position corresponding to an intake area of said cam ring, and said ports are connected to said branch passages via a gap formed between one face of said cam ring and this step.

4. A vane pump as defined in claim 1, wherein said body comprises:

a low pressure passage arranged parallel to said drive shaft, an inlet port connected to said low pressure passage for introducing hydraulic fluid from outside said pump, and a drain passage provided as an extension coaxial with said inlet port and extending to the hole through which said drive shaft passes for recirculating hydraulic fluid which has leaked into the hole back to said low pressure passage, said drain passage being arranged in a plane perpendicular to said drive shaft, and said inlet port and drain passage being formed in a one-piece construction by demolding pins.

* * * * *